United States Patent [19]

Shure

[11] 3,993,250

[45] Nov. 23, 1976

[54] APPARATUS FOR SPRAYING LIQUID MATERIALS

[76] Inventor: Alan H. Shure, 333 E. Ontario, Apt. 2701B, Chicago, Ill. 60611

[22] Filed: May 19, 1975

[21] Appl. No.: 578,647

[52] U.S. Cl. ..... 239/332; 222/383; 239/333

[51] Int. Cl.[2] ..... B05B 9/043

[58] Field of Search ..... 239/331, 332, 333, 351, 239/334, 355, 361, 367; 222/333, 382, 383, 211, 464; 310/41

[56] References Cited

UNITED STATES PATENTS

| | | | |
|---|---|---|---|
| 1,896,624 | 2/1933 | Hollands | 222/383 X |
| 1,945,164 | 1/1934 | Ruth | 239/361 |
| 2,651,545 | 9/1953 | Shotton | 239/333 |
| 2,792,974 | 5/1957 | Smith et al. | 222/383 X |
| 2,999,646 | 9/1961 | Wagner | 239/332 |
| 3,173,584 | 3/1965 | Giavasis | 222/333 X |
| 3,680,789 | 8/1972 | Wagner | 239/332 |

*Primary Examiner*—John J. Love

[57] ABSTRACT

An apparatus for spraying a liquid material which includes a pistol gripped housing for a motor driven pump and forming an inlet, a receptacle adapted to be secured to the housing adjacent the inlet and a vacuum system member secured within the receptacle and adapted to be forced into sealing relationship with the inlet when the receptacle is secured to the housing whereby said pump means will force liquid from the receptacle through a nozzle attached to the housing.

2 Claims, 3 Drawing Figures

APPARATUS FOR SPRAYING LIQUID MATERIALS

BACKGROUND OF THE INVENTION

Heretofore, when it was desired to produce a finely divided spray of oil based and water based liquid materials, such as insecticides, germicides, air fresheners, shaving lathers, hair sprays, lacquers, paints, waxes, plastic coatings and various type cleaning compositions from a hand spray, it was frequently necessary to pressurize the receptacle containing the liquid material with either freon, carbon dioxide or other type charging materials. Under pressure, such charging materials acted as a carrier for the liquid material to provide a finely divided or atomized spray upon discharge. However, such aerosol bomb devices are expensive to manufacture and require relatively complex manufacturing techniques.

More significantly perhaps, recent medical evidence has indicated that certain carriers, namely freon, have been linked to respiratory diseases, and when combined with ozone, may upon prolonged exposure be harmful to the health of the user. Thus, it is desirable to provide a hand spray apparatus for discharging liquid materials from a closed system in the form of a finely divided spray without the necessity of utilizing an aerosol bomb containing a charging material.

Most devices available for spraying liquid materials from a closed system involve either immersing the entire pumping mechanism into the liquid material or by providing an elongated inlet tube which directly contacts the liquid material. Consequently, such devices may not be readily used interchangeably between oil based materials such as paints, lacquers, hair sprays, waxes and plastic coatings, and water based liquid materials or readily adapted for use in a hand spray. Such usage of oil based materials results in the pumping mechanism becoming clogged, difficult to clean and often inoperative in that the pumping mechanism becomes frozen because of the failure of the relatively long inlet tube to properly drain such materials from the pumping mechanism.

SUMMARY OF THE INVENTION

An object of the present invention is to provide an improved hand spray apparatus for spraying a wide variety of liquid materials while reducing the chance of clogging and freezing of the pump assembly and in a manner which protects the vacuum stem during disassembly of the receptacle.

In a preferred embodiment of the present invention, the apparatus for spraying oil based and water based liquid materials includes a housing containing a pumping assembly coupled to a receptacle containing the liquid material. The housing includes a spray head mounted thereon and an opening therein adapted to receive and hold the receptacle containing a vacuum stem member having a conical shaped end portion positioned and held therein. Mounted within the housing is a motor driven pump connected to the spray head and having an inlet tube positioned adjacent the housing opening. A coupling means is provided for securing the receptacle to the housing adjacent the opening. Upon securing the receptacle to the housing, the conically shaped end portion of the vacuum stem member is forced into sealing relationship with the inlet tube of the pump assembly to provide a sealed closed system between the liquid material and the pump assembly.

Upon removal of the receptacle from the housing opening, the entire vacuum stem member is removed from the housing to shorten the drainage distance of the liquid material from the pump thereby minimizing the length of passage subject to clogging and to permit more ready fluid removal from the pump assembly to minimize freezing of the pump assembly during periods of storage.

DETAILED DESCRIPTION

Figure 1:
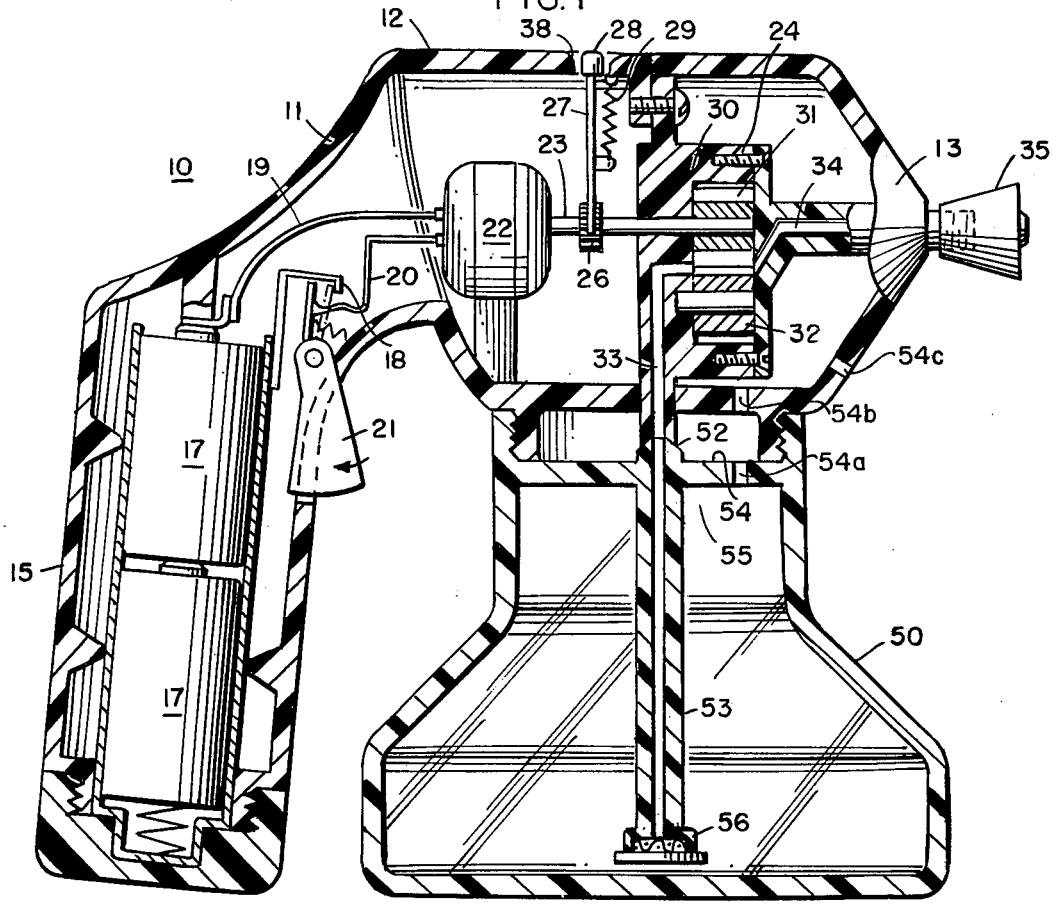
FIG. 1 is a cross-sectional elevational view of the apparatus for spraying liquid materials from a closed receptacle in accordance with the present invention.
Figure 2:
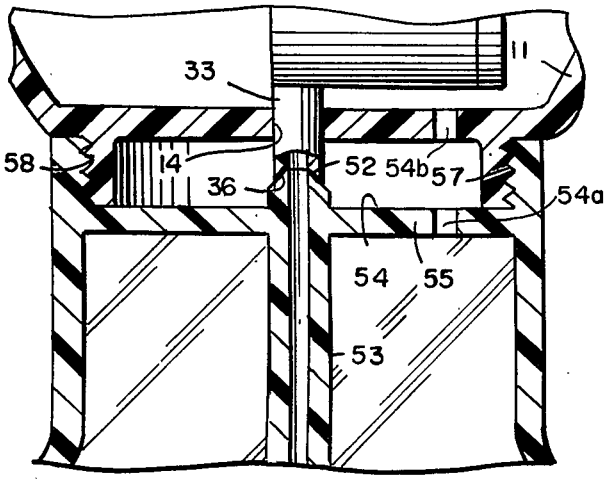
FIG. 2 is an enlarged cross-sectional elevational view showing the contact seal between the receptacle and the pump assembly in accordance with the present invention.

Referring now to the drawings, in which like reference numerals are used throughout to identify the same parts, FIG. 1 shows a portable electromechanical spraying apparatus or device 10 which is adapted to receive and cooperate with a receptacle or jar-like container 50 containing the oil based or water based liquid material to be sprayed. The liquid or fluid material to be sprayed may include insecticides, germicides, air fresheners, shaving lathers, deodorants, lacquers, paints, hair sprays, waxes, plastic coatings and various type cleaning compositions.

Figure 3:
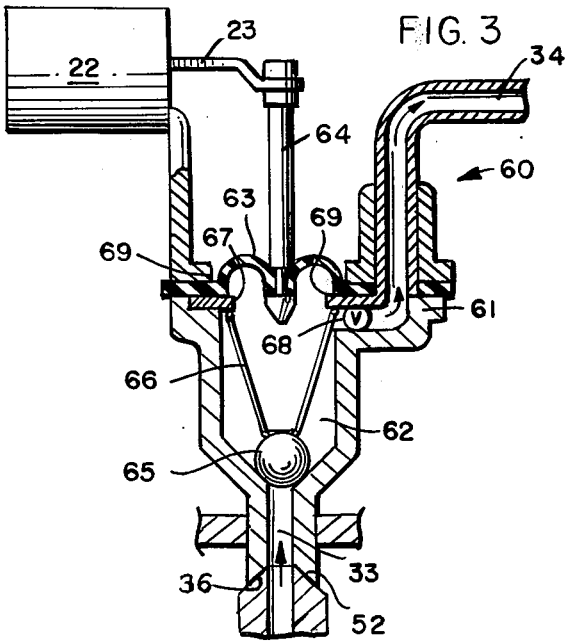
FIG. 3 is a cross-sectional elevational view of a diaphragm pump assembly in accordance with the present invention.

The hand apparatus 10 includes a housing 11 having a base portion 12 and a cover portion 13 (partially shown) mounted together, as is well known in the art. For convenience, the housing 11 may include a handle portion 15 molded integrally thereto to provide hand manipulation of the spraying apparatus 10 as desired. Mounted within the handle portion 15 of housing 11 are a pair of batteries 17 which are connected by wires 19 and 20 through switch 18 to a direct current permanent magnetic drive motor 22. A lever or trigger element 21 is provided to permit manual opening and closing of switch 18 to effect energization of the drive motor 22. The motor 22 includes an output shaft 23 which is operatively connected to the pump assembly 24 to drive the same. Various pump assemblies useful in the present invention include self-priming rotary pumps, such as gear and impeller types, and a diaphragm pump (FIG. 3).

The gear pump assembly 24 shown in FIG. 1 includes a pump housing 30 containing a first gear member 31 rotatably mounted to output shaft 23 to be driven by motor 22. The first gear member 31 is positioned within the pump housing in a meshed relationship with second gear member 32 to drive the same. The pump housing 30 includes an inlet tube 33 attached thereto which is positioned adjacent the inlet or opening 14 in the housing 11 and an outlet tube 34 which is connected to a restricted orifice spray head 35 mounted to the end of the housing. The inlet tube 33 includes a tubular or cylindrical end portion 36 which assists in providing the sealing effect between the pump assembly and the receptacle 50, as will hereinafter be described.

The receptacle or jar-like container 50 may be comprised of a plastic, metal or glass material having an open end 54 and vented to the atmosphere by means of small apertures 54A, 54B and 54C. A hollow vacuum stem member 53 extending substantially the length of the receptacle 50 is mounted and held by frame member 55 within the receptacle such that a frustoconical shaped end portion 52 on the vacuum stem member 53 is positioned and held adjacent the receptacle end 54. The frame member 55 may, if desired, be integrally molded or attached to receptacle 50 to completely enclose the receptacle and prevent spilling of the liquid material. The vacuum stem member 53 may include an end portion 56 opposite the frustoconical shaped end portion 52 which is adapted to receive a filter or screen (not shown) which assists in preventing clogging of the pump assembly during operation of apparatus 10.

Preferably, the receptacle or jar-like container 50 includes a coupling member or threads 57 on the inside surface of the container end 54 which cooperate with coupling member 58 attached to the housing 11 adjacent the housing opening 14. However, this disclosure is by way of example only, and it is within the spirit of this invention to include a structure wherein the coupling member or threads 57 are on the outside surface of the receptacle end 54 and the receptacle 50 is adapted to be screwed onto corresponding coupling member 58 attached to the housing 11 to hold the receptacle adjacent the housing opening 14. Additionally, it is further contemplated by this disclosure that when the receptacle 50 is comprised of a plastic material, the receptacle end 54 may be wedged onto the housing member 11 to be held in the housing opening 14.

During the positioning and mounting of receptacle 50 onto the housing 11 adjacent the housing opening 14, the frustoconical end 52 of vacuum stem member 53 is forced into engagement with the tubular end 36 of inlet tube 33 in an air tight sealing relationship. The outside diameter of frustoconical end 52 of vacuum stem 53 is greater than the inside diameter of inlet tube 33. Alternatively, it is within the spirit and scope of this invention to achieve the sealing relationship and contact seal between the inlet tube 33 and the stem member 53 by providing that the end portion 36 of the inlet tube 33 is frustoconically shaped and that the end portion 52 of the vacuum stem member 53 is tubularly shaped. Similarly, the outside diameter of frustoconical end 36 of inlet tube 33 is greater than the inside diameter of vacuum stem member 53. Simultaneously with the attachment of receptacle 50 to the housing 11, the frustoconical end 36 of the inlet tube is forced into engagement with the tubular end 52 of the vacuum stem member 53 in an air tight sealing relationship.

When the receptacle 50 has been secured by the housing 11 adjacent the housing opening 14 and the sealing relationship and contact seal has been formed between the end 52 of the vacuum stem member 53 and the end 36 of the inlet tube 33, upon activation or movement of trigger 21 the switch 18 is closed and the circuit between the batteries 17 and the drive motor 22 is completed. The energization of motor 22 rotates shaft 23 to drive the pump assembly 24 thereby causing the liquid material contained in receptacle 50 to flow upward through vacuum stem 53 and inlet 33 into the pump housing and out through outlet tube 34 to the spray head 35 to provide a finely divided spray.

If during the spraying operation the rotary pump assembly 24 somehow becomes clogged or inoperative to a degree that the drive motor 22 is unable to rotate the rotary pump assembly, a manual reset means or device is provided to permit the operator to manually rotate shaft 23 and thereby free the clogged or frozen rotary pump. The manual reset device includes a rachet gear 26 mounted to rotate with output shaft 23. A linkage means or lever 27 is positioned within the housing 11 and attached to a reset button 28 mounted in recessed aperture 38 in housing 11. A spring 29, anchored to the housing 11, is attached to the lever 27 to bias the lever to an outward at rest position. Thus, if the rotary pump assembly 24 becomes clogged or frozen, by pressing the button 28 inwardly into the housing, the movement thereof causes the lever 27 to engage rachet gear 26 and rotate the same. Such rotation of shaft 23 will free the pump assembly for continued operation.

Upon removal of receptacle 50 from housing 11, the air tight contact seal between the end portion 52 of the stem member 53 and the end portion 36 of inlet tube 33 is broken to permit draining of any excess liquid material or fluid from the pump assembly. Because the entire vacuum stem member is removed from the pump housing, the distance the liquid material must travel to drain from the pump assembly is substantially shortened thereby minimizing the length of passage of the vacuum stem member subject to clogging. Such a shortened drainage distance thus permits more ready fluid removal from the pump assembly and thereby minimizes the chances of the pump assembly freezing or becoming inoperative during periods of storage and nonuse.

A cap (not shown) may be provided for attachment to the receptacle end 54 for sealing the unused portion of the liquid material within the receptacle for subsequent usage and for protecting the vacuum stem from becoming damaged during storage.

FIG. 3 shows a diaphragm pump assembly having particular utility when it is desired to spray heavier type oil based liquid materials. The diaphragm pump assembly 60 includes a pump housing 61 defining a pump chamber or cavity 62 having an open end 69 therein. A rubber diaphragm member 63 is mounted to the housing to cover open end 69 and operatively connected to a connecting rod 64 mounted to an eccentric output drive shaft 23 on drive motor 22. The pump housing 61 includes an inlet tube 33 which is positioned in the housing adjacent the opening 14 in housing 11 and an outlet tube 34 which is connected to spray head 35 mounted to the end of the housing. A unidirectional valve 68 is provided in outlet line 34 adjacent the pump cavity 62 to prevent the return of the liquid material from outlet tube 34 into cavity 62 during the upward strike of the rubber diaphragm, as is well known in the art. A spring 66 is positioned within the cavity 62 and engageable with steel ball 65 to position the ball at the juncture between the inlet tube 33 and cavity 62. The ball 65 functions as a closing valve to facilitate the pumping action of the liquid through outlet 34 upon the downward stroke of diaphragm 63. The rotational movement of the eccentric output shaft 23 results in an up and down movement of diaphragm 63 which draws the liquid material into the pumping chamber 62 and then out through the outlet tube 34 to the spray head 35.

From the foregoing description the hand spray apparatus for spraying both oil based and liquid based materials provides a simple and reliable means for producing a finely divided spray while reducing the chance of clogging and freezing of the pump assembly.

I claim:

1. A hand spray apparatus for producing a finely divided spray of liquid material in which a housing of generally pistol-shaped configuration includes a pumping assembly for pumping liquid through an inlet from a receptacle out through a restricted orifice spray head associated with said housing, the improvement including:

a hollow vacuum stem member mounted within said receptacle and having a bottom end extending substantially to the bottom of said receptacle and having an upper end forming a sealing face, a fastening means on both said housing and said receptacle for moving said receptacle toward and in securing engagement to the housing, means for continuously venting the interior of said receptacle to the atmosphere, the aforesaid pumping assembly having an inlet opening forming a sealing face extending toward said upper end of said hollow stem member, and one of said sealing faces being frustoconical shaped and the other one of said sealing faces being cylindrical shaped whereby, when said receptacle is moved toward said housing and secured thereto, said frustoconical shaped sealing face is forced into an air-tight sealing relationship with said cylindrical sealing face, and, further including a manual reset means for engaging said pumping assembly when said pumping assembly is in a frozen condition to rotate the same to an operative condition.

2. The spray apparatus according to claim 1 wherein the pumping assembly is comprised of an electric-motor driven gear pump.

* * * * *